US006129130A

United States Patent [19]

Rekret

[11] Patent Number: 6,129,130

[45] **Date of Patent: *Oct. 10, 2000**

[54] DOOR EDGE DEBRIS BLOCK AND AIR SEAL

[75] Inventor: Andrew Rekret, Orillia, Canada

[73] Assignee: Proplas Ltd.

[ * ] Notice: This patent is subject to a terminal disclaimer.

[21] Appl. No.: 08/921,696

[22] Filed: Sep. 2, 1997

Related U.S. Application Data

[62] Division of application No. 08/760,994, Dec. 5, 1996, Pat. No. 5,718,276.

[51] Int. Cl.[7] ..... E06B 7/16

[52] U.S. Cl. ..... 160/40; 49/496.1

[58] Field of Search ..... 160/40, 41, 201, 160/133, 271, 272, 273.1; 49/484.1, 496.1, 197, 199

[56] References Cited

U.S. PATENT DOCUMENTS

| | | | |
|---|---|---|---|
| 3,339,619 | 9/1967 | Crosswell | 160/40 |
| 3,693,693 | 9/1972 | Court | 160/201 X |
| 4,467,853 | 8/1984 | Downey | 160/133 |
| 4,957,301 | 9/1990 | Clay et al. | 160/40 X |
| 5,445,209 | 8/1995 | Lichy | 160/41 X |
| 5,544,690 | 8/1996 | Magro et al. | 160/271 X |
| 5,718,276 | 2/1998 | Rekret | 160/201 |

*Primary Examiner*—David M. Purol

[57] ABSTRACT

A combination brushing and sealing member which fits to a garage door frame behind a garage door comprises a frame mounting portion having first and second legs meeting at a corner region of the frame mounting portion. The first leg has a front face provided with a forwardly protruding brush which wipes against the garage door. A flexible seal extends from near the corner region of the frame mounting portion forwardly of the front face of the first leg to seal against the garage door.

2 Claims, 7 Drawing Sheets

FIG. 5.
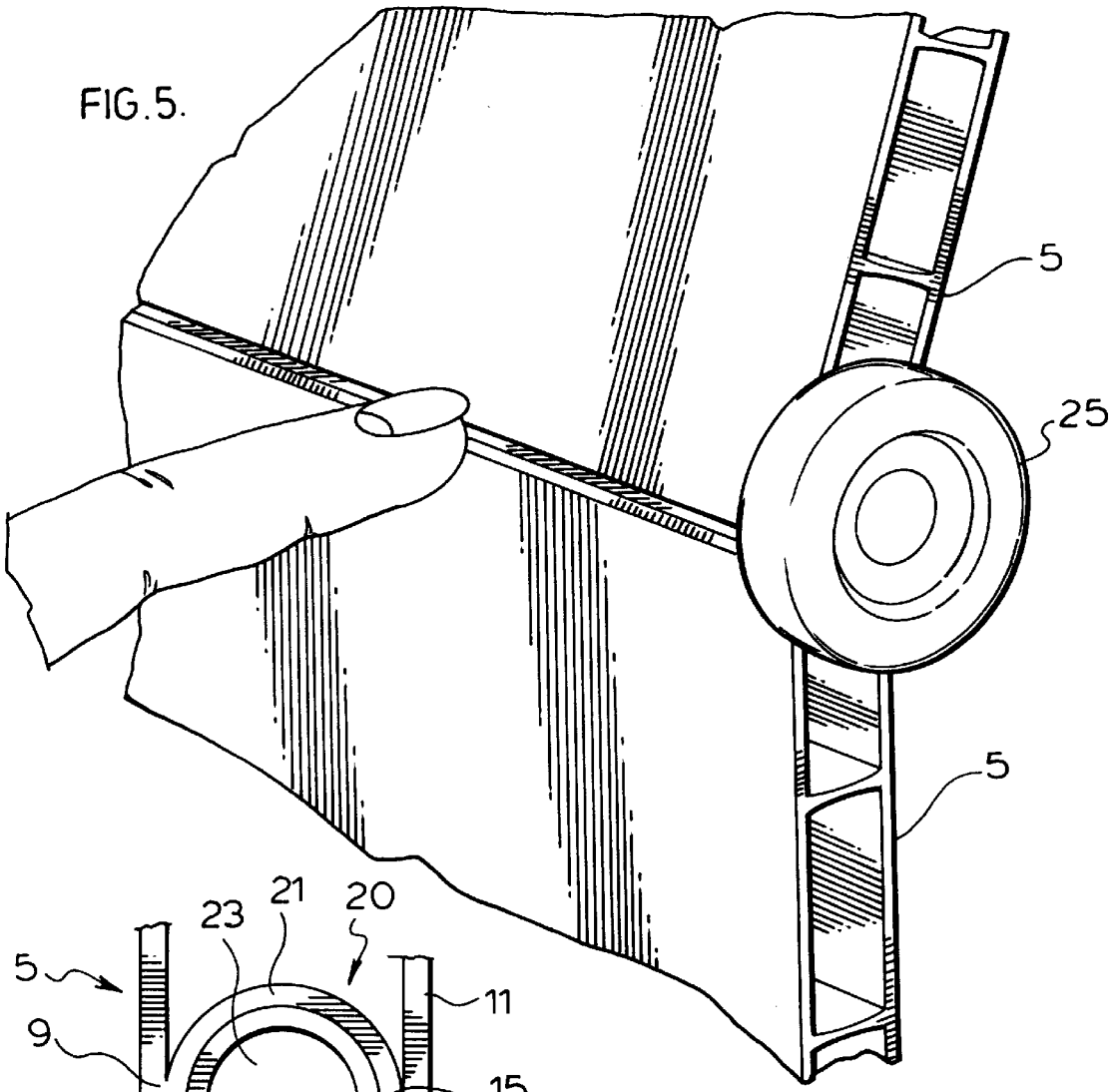
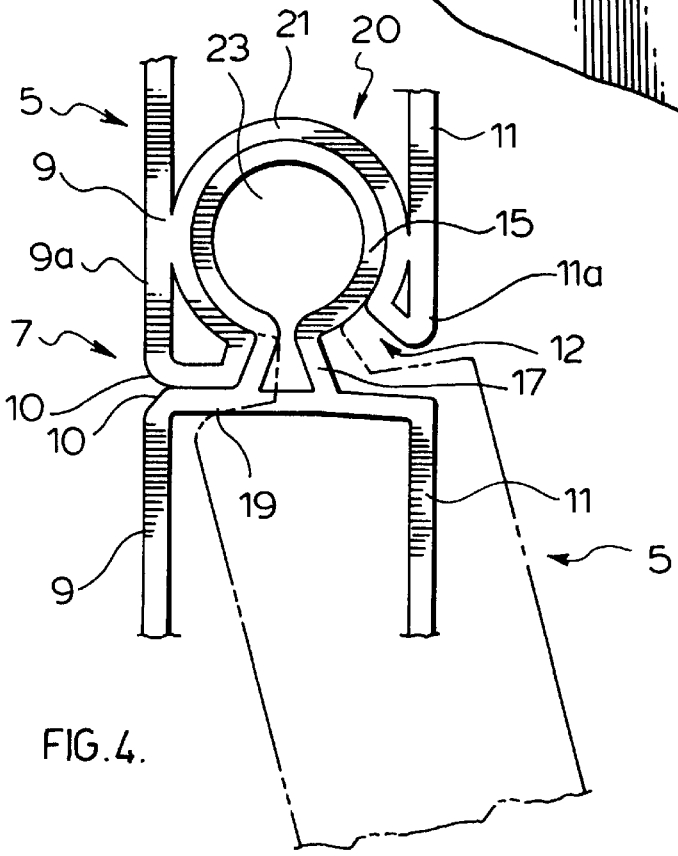
FIG. 4.

DOOR EDGE DEBRIS BLOCK AND AIR SEAL

This is a Divisional application of application Ser. No. 08/760,994 filed on Dec. 5, 1996 now U.S. Pat. No. 5,718, 276.

FIELD OF THE INVENTION

The present invention relates to a door of the rolling type formed by a series of interlocking panels connected to one another by a one way hinged connection.

BACKGROUND OF THE INVENTION

Rolling doors, ie, doors of the type made with hingedly connected panels have a number of different applications. One of the primary applications for these doors is to provide coverage for the entrance to a garage or the like.

Traditionally rolling garage doors have been made from either wood or metal. Such doors are heavy and encounter problems because of their wooden or metallic construction. For example wooden doors deteriorate over time and require relatively frequent refurbishing and/or painting. Metal doors have a tendency to rust and are very poor heat insulators because of their high thermal conductivity.

Both metal and wooden doors also suffer from the drawback that they are noisy to operate and they require, particularly in the case of the wooden doors, separate hinge connectors which are secured by mechanical fasteners to the door panels. These mechanical fasteners can loosen and release over time with use of the door.

U.S. Pat. No. 4,924,932 describes a moveable shutter formed from a series of hingedly connected panels having a thermoplastic or a polycarbonate construction. The panels of the shutter are held together by a snap connection providing a hinge between the panels. Although useful for small, light weight, shutters such a snap connection would not be capable of sustaining the weight of a much larger and heavier plastic panel as would be used for covering a large garage opening.

SUMMARY OF THE INVENTION

The present invention provides a door formed from a plurality of thermoplastic panels hingedly connected to one another. The connection between the panels is provided by panel parts integral to each panel and capable of supporting the weight of a large panel such as that required in a garage door.

More particularly each panel has a main body with an outside wall, an inside wall, an open ended female receptacle formed centrally in one end and a male connector protruding centrally on the other end of the main body. The male connector has a rounded head and a neck joining the head to a shoulder on the main body of the panel. Both the head and the shoulder are wider than the neck. The female receptacle is formed by a rounded wall provided interiorly of the main body of the panel. This rounded wall circumscribes a major part of a circle and is only interrupted by a mouth having a width slightly greater than the neck of the male connector.

The inner wall of the main body of the panel is shorter than the outer wall to provide a one way hinge connection between the receptacle of one of the panels and a connector of another one of the panels.

The connection between the receptacle and the connector is such that the connector can only be slid in position along the length of the receptacle and will not release in any other direction. This provides a very strong, efficient connection capable of holding large panels with one another. Furthermore the hinging action is achieved using parts which are integrally formed with each of the panels.

BRIEF DESCRIPTION OF THE DRAWINGS

The above as well as other advantages and features of the present invention will be described in greater detail according to the preferred embodiments of the present invention in which:

FIG. 4 is an enlarged end view showing the hinged action between the panels from the assembly of FIG. 3.

FIG. 5 is a perspective view of the panels of the assembly of FIG. 3 with all of the door parts put together with one another.

DETAILED DESCRIPTION ACCORDING TO THE PREFERRED EMBODIMENTS OF THE PRESENT INVENTION

Figure 1:
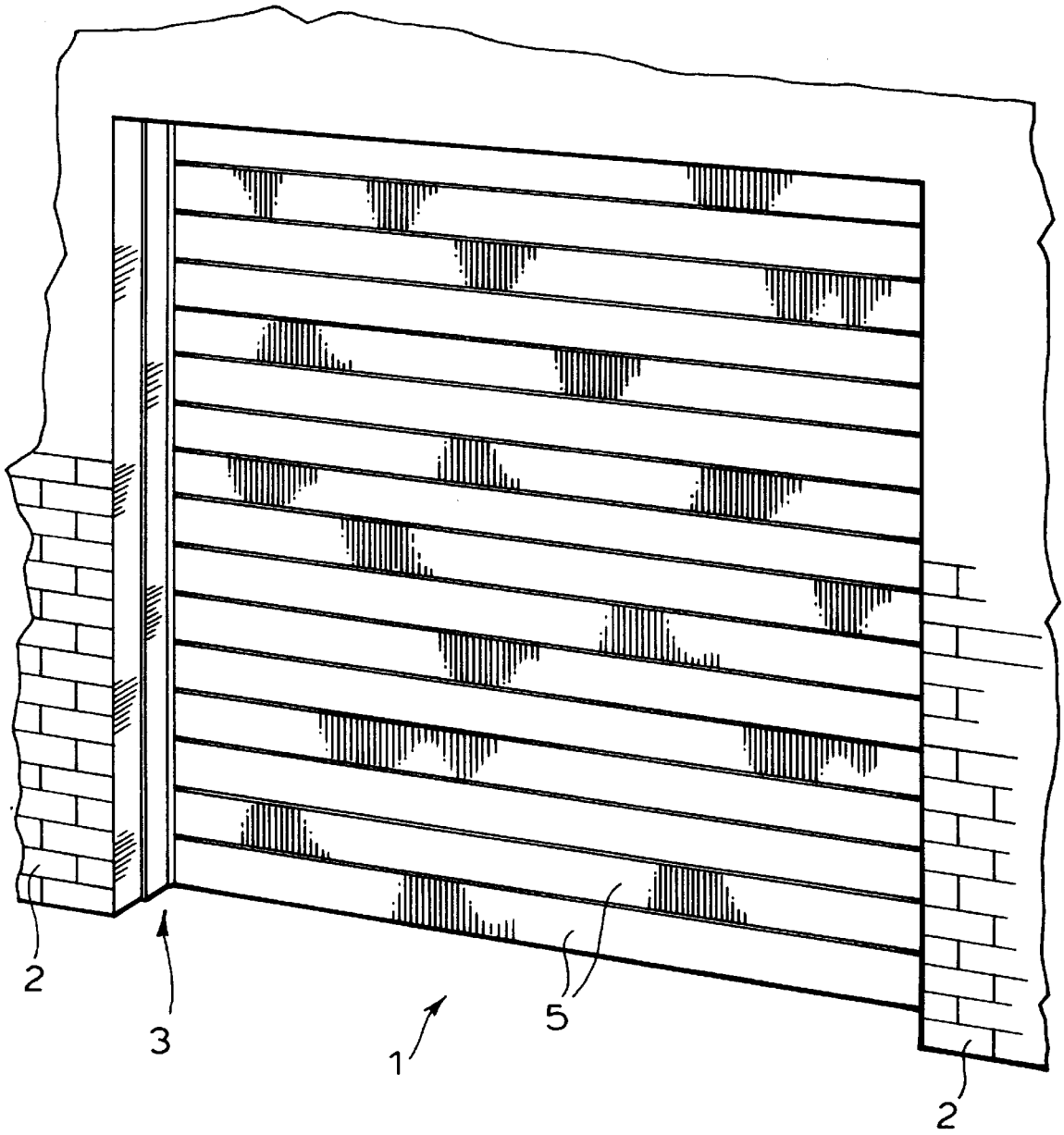
FIG. 1 is a perspective view of a garage door made in accordance with a preferred embodiment of the present invention.

FIG. 1 shows a garage door generally indicated at 1. This door is formed from a plurality of thermoplastic and preferably vinyl panels 5. These panels are secured by a one way hinged connection to one another, ie the panels are connected in a manner such that they can hinge inwardly away from one another as the door is rolled up and down but they will not go beyond a vertically aligned position towards the outside of the door.

The rolling garage door 1 is secured within a surrounding building structure 2 by means of a frame generally indicated at 3. This frame also preferably has vinyl parts for both weatherability and to provide a smooth running surface for the vinyl door 1.

Figure 2:
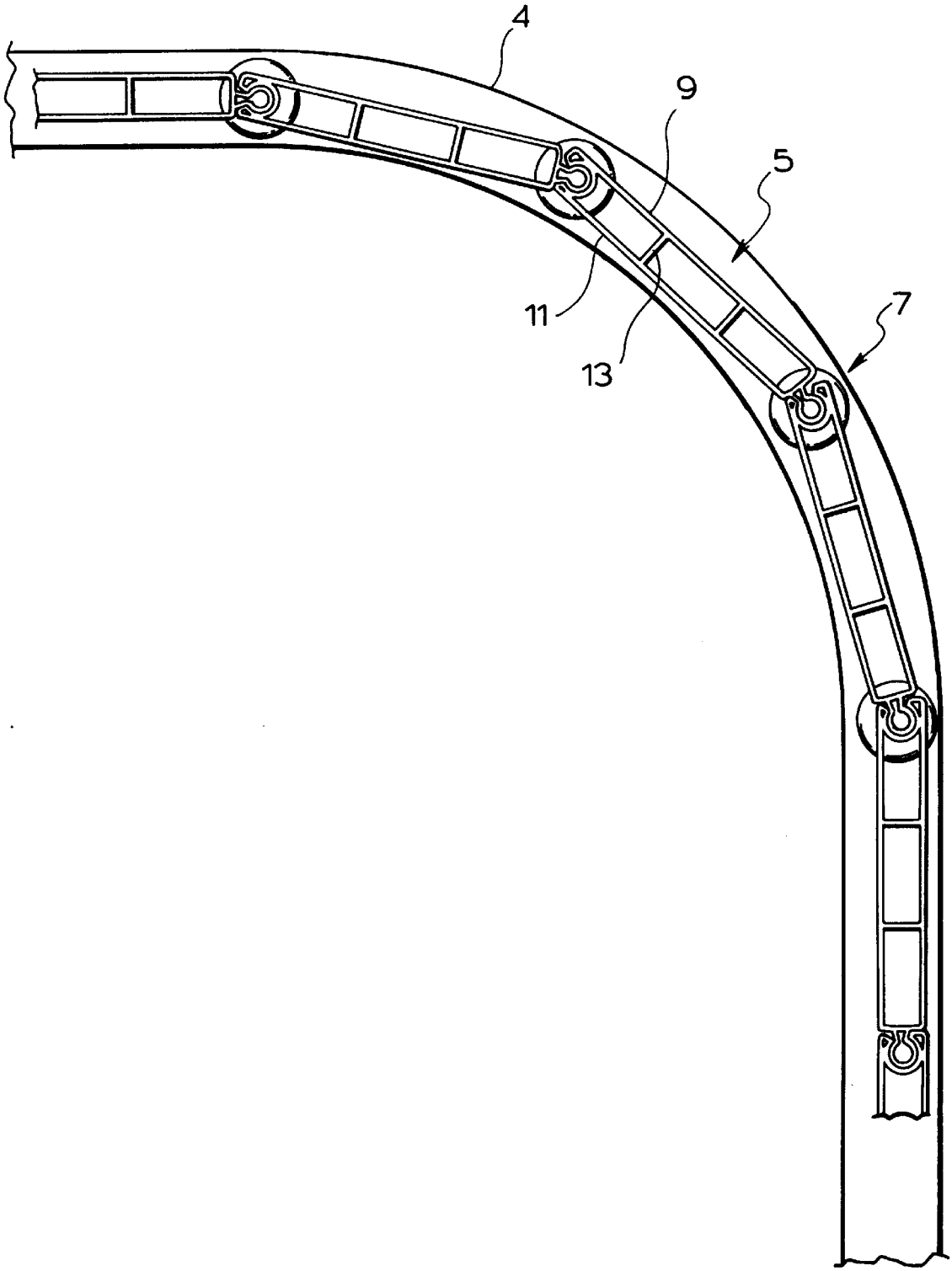
FIG. 2 is an end view of the garage door of FIG. 1 towards its upper end showing the hinging or rolling action between the door panels.
Figure 6:
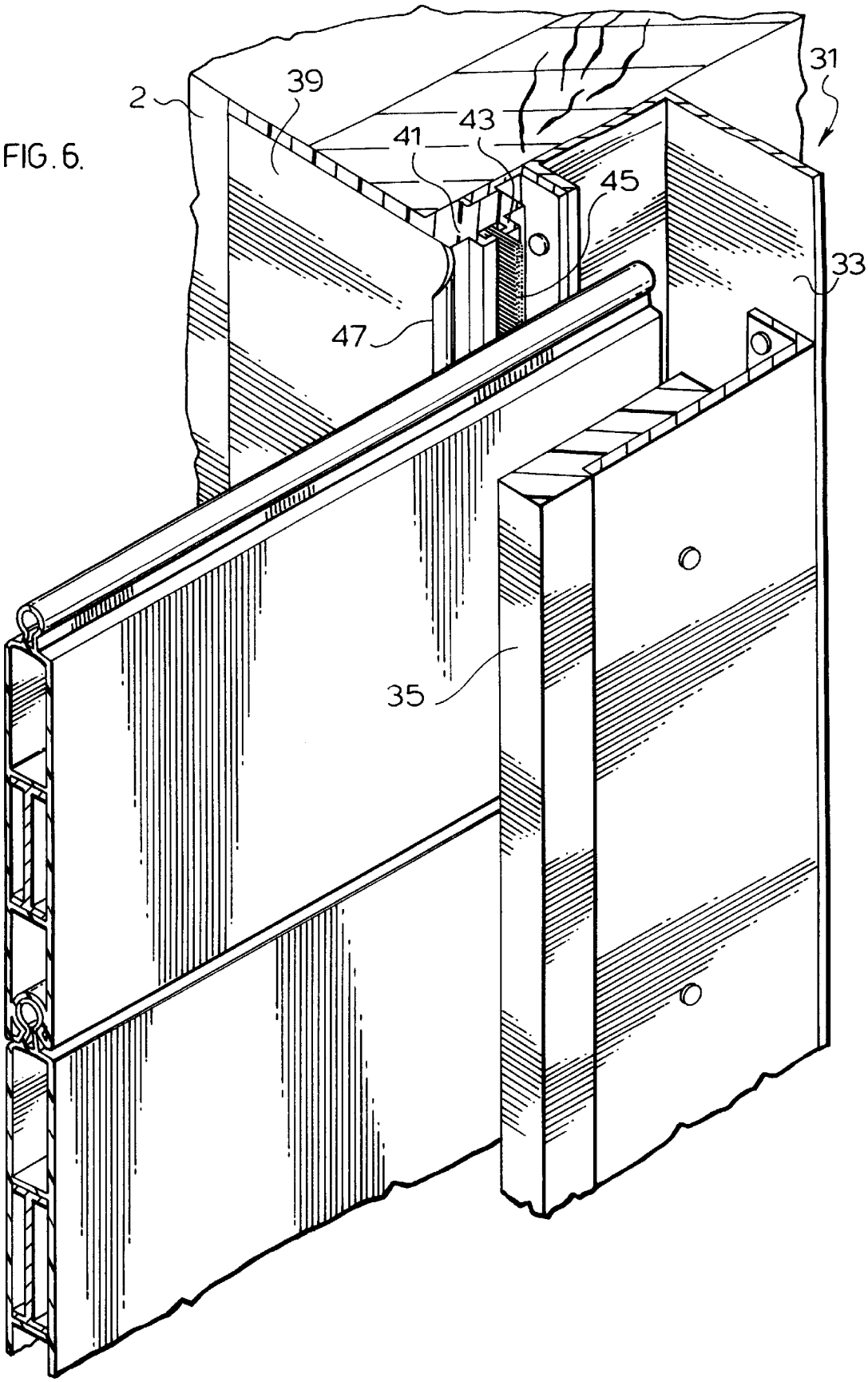
FIG. 6 is a perspective view looking down on one side of a hinged door and its mounting frame according to still a further preferred embodiment of the present invention.
Figure 7:
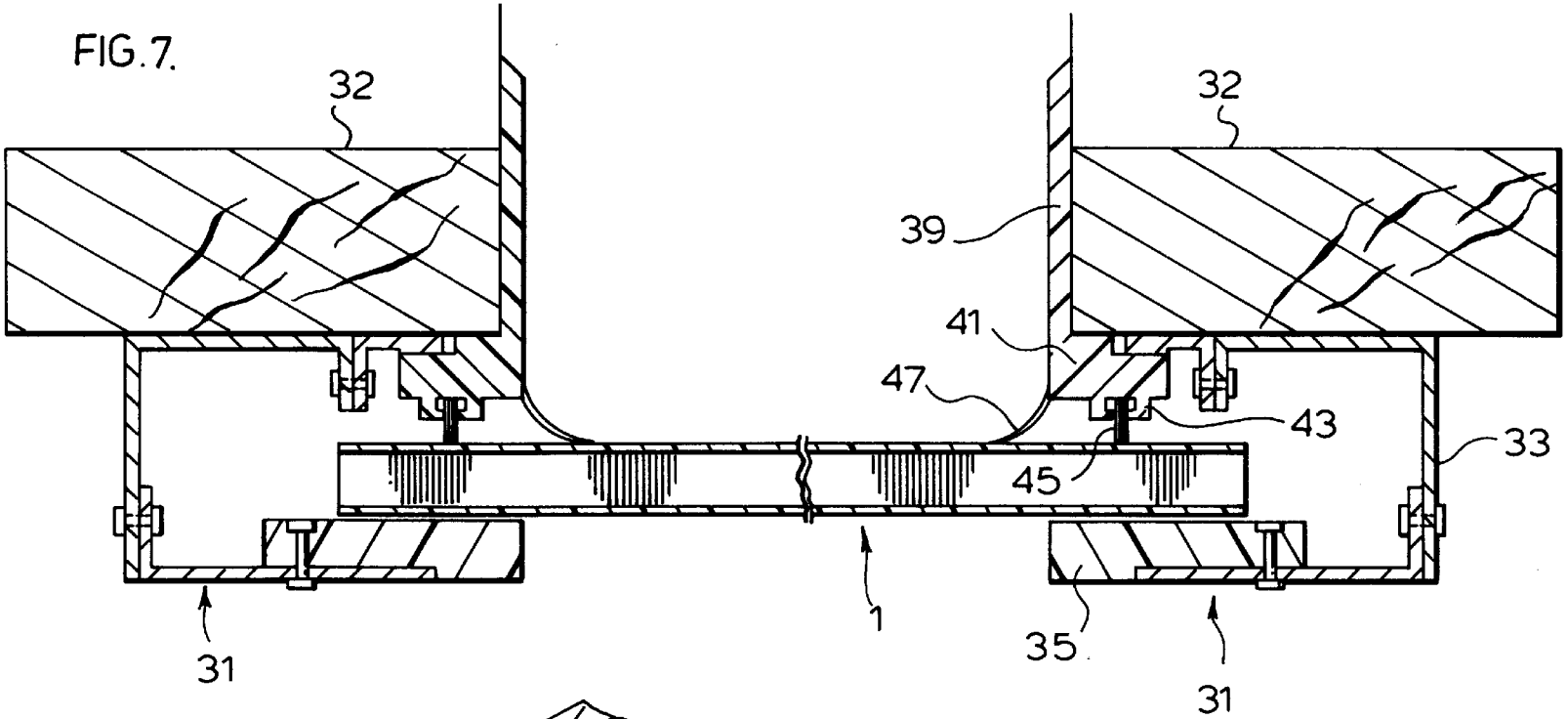
FIG. 7 is a top view of the door of FIG. 6 showing both sides of the mounting frame.
Figure 8:
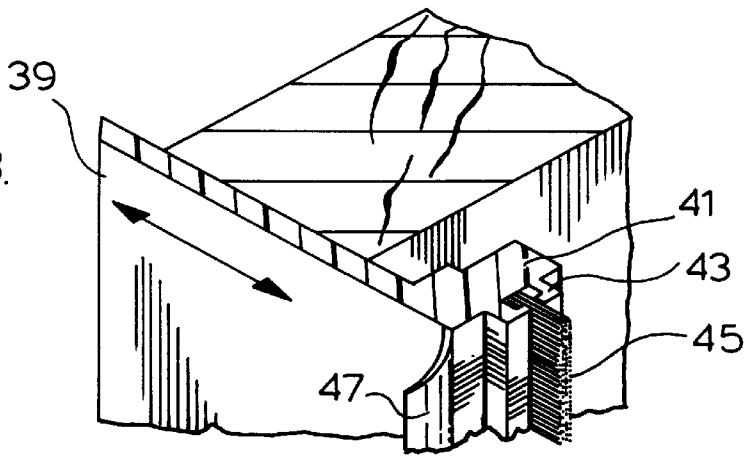
FIG. 8 is an enlarged perspective view of part of the mounting frame of FIG. 7.

Frame 3 can either be formed by a relatively uncomplicated channel 4 as indicated in FIG. 2 of the drawings or it can be a much more sophisticated construction such as frame 31 as seen in FIGS. 6 and 7 and to be described later in detail.

Figure 3:
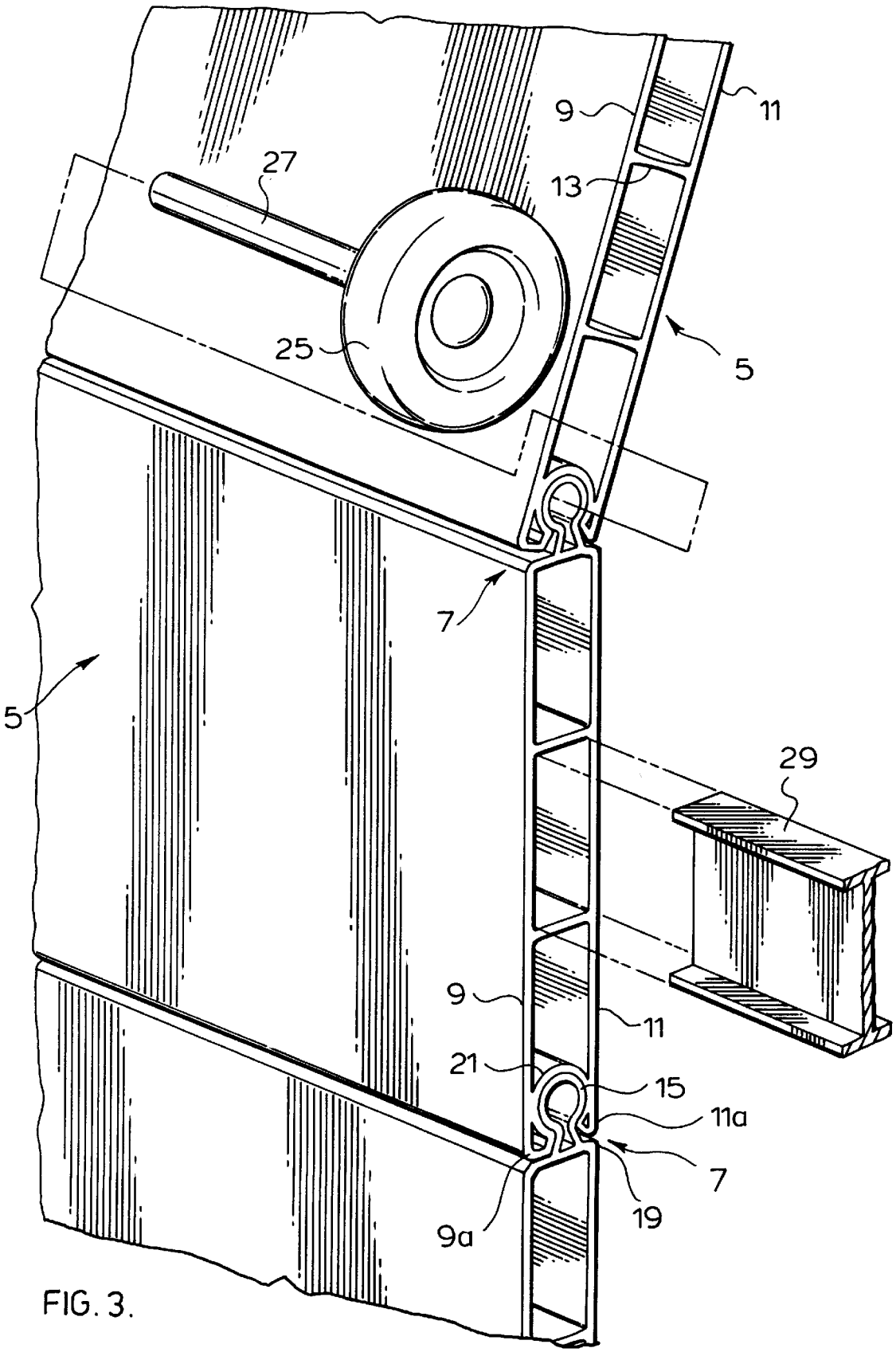
FIG. 3 is an enlarged partially exploded view of a door assembly according to a further preferred embodiment of the present invention.

The actual construction of each of the panels 5 is best seen having reference to FIGS. 3 and 4 of the drawings.

More particularly each of the panels 5 which is preferably formed in an extrusion process comprises a main generally hollow panel body with an outer wall 9 and an inner wall 11. The main panel body is internally reinforced by webs 13 traversing the outer end inner walls of the panel body.

A one way hinged connection generally indicated at 7 is found between each of the panels 5. This hinged connection is provided by means of a male connector comprising a rounded head 15 protruding centrally from one end of the main panel body and a female receptacle generally indicated at 20 centrally of the interior of the main body at the other end of the panel. As will be understood from the drawings the male connector from one panel fits into the female receptacle on an adjacent panel. This can only be accomplished by sliding the connector lengthwise along receptacle which has open ends to each side of the panel. Once the door is fitted within its frame the frame prevents the panels from separating from one another.

The female receptacle is formed between the outer wall 9 and the inner wall 11 of the main panel body by means of a rounded wall 21. This wall circumscribes the major part of a circle, ie, it extends through an arc greater than 180 degrees and preferably through an arc of about 270 degrees or more. Other than through its opened ends the only entrance to the female receptacle is at a receptacle mouth generally indicated at 12 defined between the end portion 9*a* of outside panel wall 9 and the end portion 11*a* of inside panel wall 11. However as noted above the mouth of the female receptacle is not wide enough to permit passage of the connector head through the receptacle mouth.

The male connector 15 is formed as a rounded head with a much narrower base or neck 17 securing the head 15 to a wider shoulder 19 at the end of the main body of the panel. The head 15 of the connector has an outside diameter substantially the same as that as the inside diameter of the wall 21 forming the female receptacle. This eliminates any loose play between the two.

The mouth 12 of the female receptacle has a width which is only slightly greater than that of neck 17 of the male connector for a relatively limited pivoting action of the connector within the receptacle. This pivoting action occurs in one direction only ie towards the inside of the door because the end portion 9*a* of the outside wall 9 of the panel provides a stop against the shoulder 19 to the adjacent panel when the two panels are in alignment with one another. In contrast there is a gap between the end portion 11*a* of the interior wall 11 and the shoulder 19 of the adjacent panel to the inside of the door. This in combination with the fact that the receptacle mouth 12 opens at an upward inward angle allows an inward hinging action between the connected panels.

A very important feature of the invention is that the door is designed to eliminate or at least substantially eliminate the possibility of a person getting his or her fingers caught between the panels as they close against one another at the outside of the door. As will be seen in FIG. 4 each outside wall has a bevelled end 10. These bevelled ends have a tendency to push outwardly on anything such as a finger as shown in FIG. 5, when the panels come together to form a V-shaped gap along the outside wall between the panels in their aligned closed positions. This is to be contrasted to a conventional rolling garage door having a standard right angle edge which does not have any outward pushing effect and in which fingers do often get caught and crushed.

Rather than shortening the inside end wall portion 11*a* relative to the outside end wall portion 9*a* the one way hinging action can be provided by making the two end portions 11*a* and 9*a* level with one another and recessing the inside shoulder of the panel. In other words the shortening of the inside wall relative to the outside wall can be done at either end of the inside wall to provide the one way hinging action between the two connected panels.

As earlier described the door frame 3 can be formed with a relatively standard U-shaped channel 4. This channel may be made only slightly wider than the width of the panels themselves so that the panels fit directly in the channel with just enough clearance to allow a guided sliding action of the door within the channel. The vinyl to vinyl contact between the channel and the door provides a smoothness to this action.

In another embodiment of the invention, the guiding track for the door is sized to receive a roller 25 which is preferably made from steel or aluminum. Roller 25 has an axle 27 which is press fitted into the hollow interior 23 of the rounded male connector 25. With this arrangement the hinged connection between the panels is not only formed by parts integral to both panels but in addition the hollow construction of the connector head provides a natural bore for the roller axle 27 without any modifications or additional features needed to be added to the hinged connection.

For most applications the hollow webbed construction of the vinyl is more than sufficient in strength. However for extremely large doors or doors covering secured areas it may be desirable to insert reinforcing members such as I beam 29 within one or more of the hollow chambers of the door panels 5 as shown in FIG. 3 of the drawings.

The frame generally indicated at 31 in FIGS. 6 and 7 is shown when used with the vinyl garage door 1. It can also be used with rolling doors made with other than a vinyl construction. Frame 31 is designed to both guide the slide action of the door and to substantially isolate the interior of the structure which the door is covering from outside weather elements.

More particularly frame 31 comprises substantially U-shaped and preferably metal channel 33 formed by a series of channel elements secured to one another as shown in the drawings. The inside leg of channel 33 is secured to the outside of the building structure 32. A vinyl pad or plate 35 is secured along the inside edge of the outside leg of the channel. This vinyl pad runs the full height of the channel.

Also provided on the building structure 32 is a vinyl corner member formed by a main body or plate 39 and a thicker leg 41 at right angles to the plate 39. The corner element wraps around the corner of the garage opening with the plate 39 and the leg 41 providing means for attachment of the corner element to the building construction.

Leg 41 is provided with a small channel 43 in which a brush 45 or similar sweeping element is provided. A seal 47 is provided inwardly of the brush 45. This seal is made of relatively flexible vinyl material coextruded with the harder base plate 39 of the corner element.

Brush 45 performs two functions. Firstly it acts as a flexible bias member forcing the door outwardly against pad 35. Therefore there is a surface to surface contact between the door and the pad. This contact helps to reduce leaves and other debris from entering the channel 33. Both the brush and the vinyl pad to opposite sides of the door act as relatively frictionless guides for the door.

As a second function, brush 43 acts as a secondary debris block to the inside of the door.

The primary function of seal 47 which is pressed up against the inside of the door is to essentially eliminate airflow around the door. This helps to isolate the inside temperature of the building from temperatures outside of the building. Brush 43 allows seal 47 to perform its function by preventing debris from breaking the seal between the sealing member 47 and the door surface.

Figure 9:
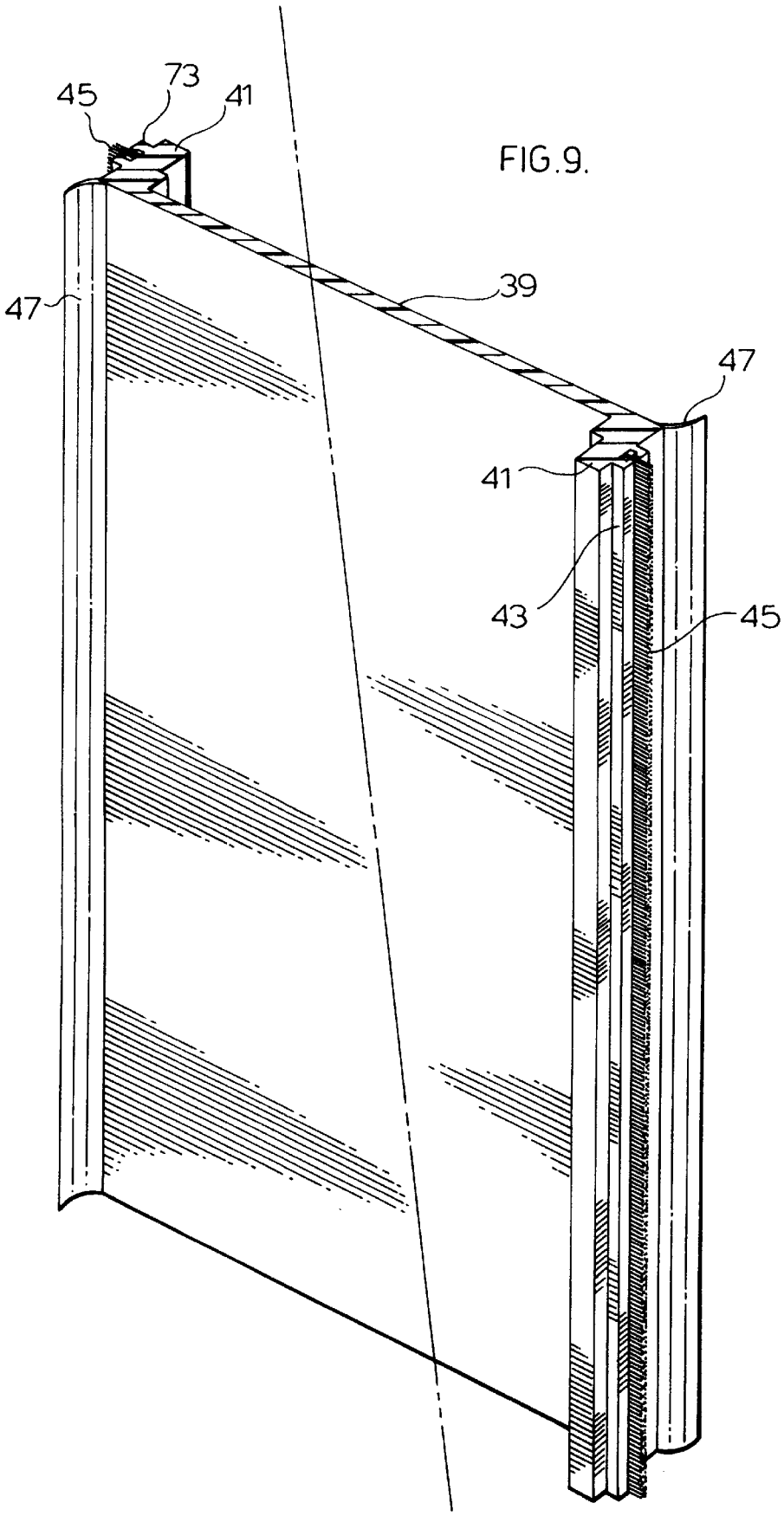
FIG. 9 is perspective view of part of the mounting frame of FIGS. 6 and 7 after its initial formation and prior to its assembly with the remainder of the mounting frame.

As can be seen in FIG. 7 frame 31 is identical on opposites sides of the door. This necessitates the use of two corner members which as shown in FIG. 9 of the drawings can be formed in a single extrusion process having a common base plate 39. The base plate can then be severed to provide the two required elements.

Although various preferred embodiments of the present invention have been described herein in detail, it will be appreciated by those skilled in the art, that variations may be made thereto without departing from the spirit of the invention or the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. A combination debris and air block to be mounted peripherally of an entranceway of an enclosure, said block comprising a rigid mounting base having a front face formed by a first leg having a free outer end and an inner end meeting at a corner region of said mounting base with a second leg integrally formed with said first leg, said second leg being at right angles to and extending rearwardly from said first leg, a flexible seal at said corner region and a brush between said flexible seal and said outer end of said first leg, both said flexible seal and said brush protruding forwardly of said front face to press against an inwardly facing surface of a door covering the enclosure and wherein both said mounting base and said flexible seal have a unitary plastic construction comprising a first hard plastic material forming said mounting base and a second softer material coextruded with said first material to form said flexible seal.

2. A block as claimed in claim 1, wherein said brush has a brush base slideably secured within a brush receiving channel provided on said first leg of said mounting base.

* * * * *